US006634956B1

(12) United States Patent
Pegg

(10) Patent No.: US 6,634,956 B1
(45) Date of Patent: Oct. 21, 2003

(54) FREE STANDING PUTTER

(76) Inventor: Jeffry A. Pegg, 954 C.R. 3657, Springtown, TX (US) 76082

( * ) Notice: Subject to any disclaimer, the term of this patent is extended or adjusted under 35 U.S.C. 154(b) by 185 days.

(21) Appl. No.: 09/393,374

(22) Filed: Sep. 10, 1999

(51) Int. Cl.[7] ..... A63B 69/36; A63B 53/04; A63B 53/02

(52) U.S. Cl. ..... 473/251; 473/313; 473/300; 473/340; 473/341

(58) Field of Search ..... 473/324, 313, 473/251, 243, 256, 238, 242, 340, 341, 349, 328, 219, 231

(56) References Cited

U.S. PATENT DOCUMENTS 4,173,343 A * 11/1979 Richilano
4,462,595 A * 7/1984 Hodson
5,282,622 A * 2/1994 Evans
5,290,035 A * 3/1994 Hannon
5,855,525 A * 1/1999 Turner
D421,471 S * 3/2000 Moldovan

* cited by examiner

*Primary Examiner*—Sebastiano Passaniti
(74) *Attorney, Agent, or Firm*—Jack A. Kanz

(57) ABSTRACT

A free standing putter is formed by appropriately weighting the putter head relative to the shaft and grip and forming a foot surface on the putter had which permits the putter to stand alone on the green without external support. The free standing putter permits the golfer to view the geometric relationship of ball, cup, putter and topography of the green from various distances and perspectives.

14 Claims, 1 Drawing Sheet

FREE STANDING PUTTER

BACKGROUND OF THE INVENTION

This invention relates to golf putters. More particularly, it relates to putters which may be placed in striking position on a golf green and remain standing in striking position without external support so that the user may view alignment of the putter face with respect to the cup, the ball and topography of the green from positions removed from the location of the putter.

Since golf courses are usually designed with par values for each hole which allow for two putts per hole, it is evident that putting contributes significantly to a golfer's total score. Accordingly, successful and effective putting is highly desireable.

A wide variety of putters is available, all theoretically designed to aid the golfer in learning proper putting technique and/or improving the golfer's putting skill and effectiveness. Golfers generally agree that the primary problems encountered in proper putting relate to controlling direction of the ball and to controlling the energy imparted to the ball to drive it to the hole. Direction is the path the ball must follow (and thus the direction in which it must be moved by the putter) and is determined by the contour of the green, i.e., the topography of the green between the ball and the cup. The energy to be applied is determined by the distance the ball must travel and the resistance provided by the green (green speed).

Ordinarily, golfers are trained to swing the putter in a pendulum motion when striking the ball to best control the force applied to the ball. The pendulum motion aids the golfer in controlling the force (energy) applied as well as maintaining the angle of the face of the putter with respect to the ball. To determine the desired direction, it is usually necessary to view the topography of the green and the relationship between the ball, the cup and the striking face of the putter from a distance and from different perspectives to determine the desired path of the ball. In conventional putters, however, the relationship between the putter face, the ball and the cup can only be viewed from directly over the ball with the golfer in the putting position.

BRIEF SUMMARY OF THE INVENTION

In accordance with the present invention putters are provided which are appropriately weighted, balanced and aligned to provide a balanced pendulum motion when striking the ball and maintain the face of the putter aligned in the desired direction of travel. The putters of the invention are also weighted, balanced and aligned so that when the bottom face of the putter is placed on the green the entire putter will remain free standing in the striking position so that the golfer may move freely about the green to analyze the topography of the green and determine appropriate alignment for directional control of the path to be traversed by the ball. By balancing the putter to permit free standing use thereof, the putter may also be used as a training device to assist in instructing proper use of the putter and may be used as well by amateur and professional golfers. By balancing the putter and controlling the mass of the putter relative to the shaft and grip, the putter of the invention provides an advantageous pendulum motion to the stroke, thus. aiding the golfer in accurately and precisely controlling the energy applied to the ball to control distance. Other features and advantages of the invention will become more readily understood from the following detailed description taken in connection with the appended claims and attached drawing in which:

DETAILED DESCRIPTION OF THE INVENTION

Figure 1:
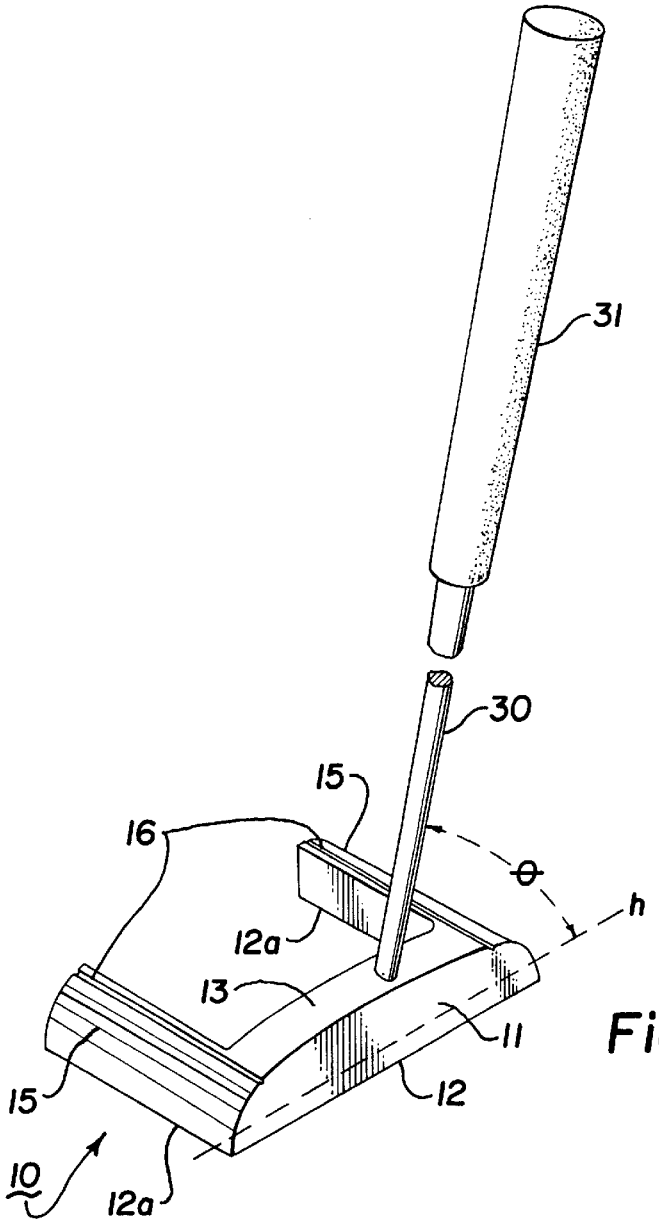
FIG. 1 is a perspective view of a preferred embodiment of the putter of the invention (illustrated with a portion of the shaft deleted)

The drawing is incorporated into and forms part of the specification to illustrate exemplary embodiments of the invention. For clarity of illustration, like reference numerals designate corresponding elements throughout the drawing. It will be recognized that the principles of the invention may be utilized and embodied in many and various forms. In order to demonstrate these principles, the invention is described herein by reference to specific preferred embodiments. The invention, however, is not limited to the specific forms illustrated and described.

Figure 2:
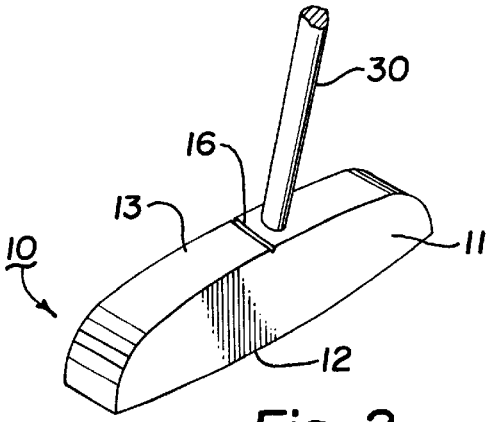
FIG. 2 is a perspective view of an alternative embodiment of a putter head for the putter of the invention.
Figure 3:
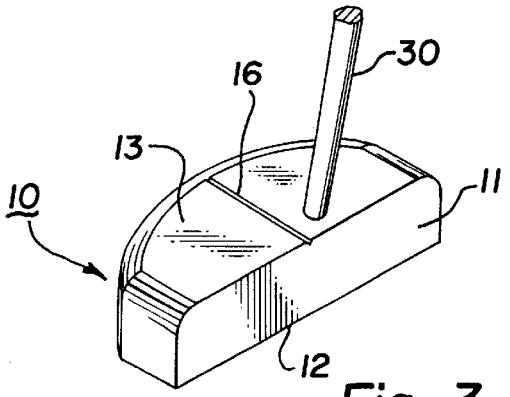
FIG. 3 is a perspective view of another alternative embodiment of a putter head for the putter of the invention.

The embodiment of the putter illustrated in FIG. 1 comprises a head 10 supported on one end of a conventional shaft 30 having a grip 31 on the opposite end thereof. So long as the combined mass of the shaft and grip comply with the mass requirements specified herein, these components may be conventional. Accordingly, the putter heads of FIGS. 2 and 3 are illustrated without the upper portion of the shaft.

Each putter head 10 comprises a body having a striking face 11, a bottom face 12 and a top face 13. The head 10 may be formed of any suitably dense material such as brass, steel or other composition. If desired, striker plates (not illustrated) of other materials such as titanium or the like may be inserted in the striking face 11. Otherwise, the body of the putter head is of uniformly dense material which weighs at least about fourteen (14) ounces.

The striking face 11 may be flat or slightly convex (vertically and/or horizontally), as desired. The striking face 11 may be either positively or negatively inclined to suit the preferences of the golfer. Regardless of these minor variations, the striking face may be described as substantially vertical and is appropriately finished to provide the desired striking surface. The exterior finish on the remainder of the head 10 is determined merely by aesthetics.

The putter head illustrated in FIG. 1 is essentially in the form of a perimeter or edge-weighted blade. The putter head illustrated in FIG. 2 is a more conventional blade design and the putter head in FIG. 3 is shaped more like a conventional mallet. All three shapes illustrated, as well as various other shapes, may be employed in the putter of the invention.

In order to permit the putter to stand unattended in striking position, the putter head 10 defines a striking face 11 which extends at least about four inches along the horizontal axis (shown as dashed line h in FIG. 1) and the shaft 30 extends from the top surface 13 at an angle of about 10° to about 25° from vertical with respect to horizontal (about 65° to about 80° from horizontal line h as illustrated at θ in FIG. 1).

To support the putter on the green, the bottom face 12 defines a foot surface which extends in two dimensions in substantially a single plane. In the putter head of FIG. 1, the foot surface is defined by the bottom face 12 adjacent and parallel with striking face 11 and the lower surfaces 12*a* of the lateral portions 15 which extend rearwardly from the lateral ends of the putter face to define a substantially U-shaped foot surface.

In the embodiment of FIG. 1 the lateral portions 15 extending rearwardly (normal to the striking face 11) not only provide perimeter weighting of the putter head but also provide additional mass to the putter and thus stationary stability. Alignment guides 16 may be formed on the top surfaces of the lateral portions 15, preferably extending the full depth of the putter head. The alignment guides 16 are arranged normal to the striking surface for use as aids in visually aligning the striking face 11 normal to the desired path of the ball at the time the ball is stroked.

In the embodiment of FIG. 2 the putter head 10 is more in the shape of a conventional blade and the bottom face 12 is slightly convex. Nevertheless, the putter head 10 of FIG. 2 (while somewhat less stable than the design of FIG. 1) will remain free standing so long as the mass of the head is at least about fourteen (14) ounces and the combined mass of the shaft and grip is less than about three (3) ounces. The bottom face 12 is slightly curved along the horizontal axis to permit slight variation in the angle of the plane of the swing without permitting the lateral edges of the putter head to engage the green. Since the bottom surface 12 is only slightly convex, for purposes of this invention the slightly convex surface 12 may be considered to lie substantially in a single plane.

In the embodiment illustrated in FIG. 3, the putter head 10 is more in the shape of a conventional mallet. As illustrated, the bottom face 12 is flat and thus the entire bottom face 11 defines the foot surface. A single alignment guide 16 traverses the center of the putter head 10. While only a single alignment guide in the form of a groove is shown, it will be readily apparent that more than one alignment guide may be provided and the alignment guide may be formed by other means such as painting, raised surfaces, etc.

In the preferred embodiment the bottom face is flat and defines a foot surface which is about four (4) inches long in a plane parallel with the horizontal axis. A depth of only two inches thus defines a foot surface of about eight (8) square inches. It will be recognized, of course, that the bottom face need not be flat. For example, the bottom face may be concave or otherwise formed so that the foot surface is defined by a ridge (continuous or discontinuous) adjacent the periphery of the bottom face. As shown in FIG. 1, the foot surface may even be irregular in shape. However, the foot surface shown circumscribes an area which is at least about four inches wide (parallel with the horizontal axis) and at least about two (2) inches deep (normal to the striking face).

While only three distinct shapes of putter heads are illustrated, it will be apparent that various combinations of the features disclosed may be used in a putter heads of various shape to incorporate and utilize the features of the invention. In the preferred embodiment, the mass of the head is approximately fourteen (14) ounces and the combined mass of the shaft and grip is about three (3) ounces or less. The bottom face 12 of the head 10 must define a foot surface which lies substantially in a single plane which may be slightly curved, either convex or concave. To ensure that the putter remains free standing when the shaft extends from the surface at an angle of about 10° to about 25°, the width of the foot surface should be approximately four (4) inches. The depth (front to rear) of the foot surface is less critical. Obviously, a longer dimension for depth provides a more stable free standing putter.

By appropriately positioning and balancing the components to provide a free standing putter, the golfer may position the putter adjacent the ball and then view the relationship between ball, cup and putter from various angles and from various distances to determine the desired course of the ball. While the putter of the invention is slightly heavier than conventional putters, the additional mass is concentrated behind the striking face 11 and at the end of the shaft. Accordingly, the additional concentrated mass assists the user in developing a uniform pendulum stroke to control the force applied to the ball.

All components of the putter of the invention may be fabricated from readily available materials using conventional techniques and the shapes of various components may be modified to satisfy the particular desires of the individual golfer. Accordingly, the principles of the invention may be used to make putters of various designs, only some of which are illustrated herein. It is to be understood, therefore, that even though numerous characteristics and advantages of the invention have been set forth in the foregoing description together with details of the structure and function of the various embodiments, this disclosure is to be considered illustrative only. Various changes and modifications may be made in detail, especially in matters of shape, size, arrangement and combination of parts, without departing from the spirit and scope of the invention as defined by the appended claims.

What is claimed:

1. A free standing putter comprising:

(a) a putter head having a mass of at least fourteen ounces defining a bottom face, a top face and a, striking face which extends in a substantially vertical plane from said bottom face toward said top face and defines a horizontal axis; and (b) a shaft extending from the top face of said putter head at an angle of from about 10° to about 25° from vertical with respect to said horizontal axis having a grip adjacent the end opposite said putter head, said shaft and said grip having a combined mass of no more than three (3) ounces.

2. A putter as defined in claim 1 wherein said striking face extends about four inches along a plane substantially parallel with said horizontal axis.

3. A putter as defined in claim 1 wherein said bottom face defines a foot surface which lies in substantially a single plane substantially normal to the plane of said striking face and extends at least about four inches in a direction substantially parallel with said horizontal axis.

4. A putter as defined in claim 3 wherein said foot surface includes lateral portions extending from and substantially normal to said striking face.

5. A putter as defined in claim 4 wherein said foot surface is substantially U-shaped in said substantially single plane.

6. A free standing putter comprising:

(a) a putter head having a mass of at least fourteen ounces defining a bottom face, a top face and a striking face which extends in a substantially vertical plane from said bottom face toward said top face and extends four inches in a substantially horizontal plane to define a horizontal axis;

(b) a foot surface on said putter head which lies in a plane substantially normal to the vertical plane of said striking face and defines an area of at least eight square inches; and (c) a shaft extending from the top face of said putter head.

7. A putter as defined in claim 6 wherein said bottom face is substantially flat and defines said foot surface.

8. A putter as defined in claim 6 wherein said foot surface includes lateral portions extending from and substantially normal to said striking face.

9. A putter as defined in claim 8 wherein said foot surface is substantially U-shaped.

10. A putter as defined in claim 6 wherein said bottom face is concave and said foot surface is defined by peripheral edges of said bottom face.

11. A putter as defined in claim 6 wherein said foot surface is defined by ridges projecting from said bottom face.

12. A putter as defined in claim 6 wherein said shaft includes a grip on the end thereof remote from said putter head and the combined mass of said grip and said shaft is less than about three (3) ounces.

13. A putter as defined in claim 6 wherein said shaft extends from said top face of said putter at an angle of from about 10° to about 25° from vertical with respect to said horizontal axis.

14. A putter as defined in claim 6 including an alignment guide on said top surface.

* * * * *